United States Patent [19]

Shames et al.

[11] 4,340,988

[45] Jul. 27, 1982

[54] CANISTER AUGER

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 242,463

[22] Filed: Mar. 11, 1981

[51] Int. Cl.[3] ..... B08B 9/02

[52] U.S. Cl. ..... 15/104.3 SN; 279/83

[58] Field of Search ..... 15/104.3 SN, 144 R, 15/145, 176; 279/83

[56] References Cited

U.S. PATENT DOCUMENTS

| | | | |
|---|---|---|---|
| 2,245,823 | 6/1941 | Rappaport | 15/104.3 SN |
| 2,470,225 | 5/1949 | Silverman | 15/104.3 SN |
| 3,609,788 | 10/1971 | Mier | 15/104.3 SN |

OTHER PUBLICATIONS

Illinois Faucet Co. publication; "Blockage Buster", Drain Cleaning Tool; 1976.

*Primary Examiner*—Edward L. Roberts

*Attorney, Agent, or Firm*—Norman Lettvin

[57] ABSTRACT

A canister auger of inexpensive construction is provided by forming the handle and canister of molded plastic parts, so that only minimal portions of the assembly require metal parts. The construction and design provide effective bearings between the canister and the handle. The canister is formed by a pair of molded shells which are secured together by fasteners. The clamp for engaging the auger wire utilizes a thumb screw and standard nut of metal cooperating with plastic parts in such a manner that effective operation, at reduced cost of parts, is achieved.

9 Claims, 3 Drawing Figures

CANISTER AUGER

FIELD OF THE INVENTION

This invention relates to a manual auger device, and more particularly to an improved construction thereof wherein major portions are formed of molded plastic parts.

BACKGROUND OF THE INVENTION

An auger of the type herein disclosed is known to include an elongated, helically wound, wire shaped to provide at the free, or working, end of the wire an enlarged helical head which is shaped to enter, and cut into or through, a mass of debris. The enlarged head extends from an elongated flexible tubular drive body defined by closely positioned turns of the helical wire. A rotary drive means for the auger includes means that grip said tubular drive body at a point spaced from said head.

In prior constructions the rotary drive means and grip of the tubular drive body included a metal sleeve through which said auger's drive body extended, and with said metal sleeve being radially tapped to receive therethrough the stem of a thumb screw whose free end could be selectively manually advanced or withdrawn, respectively to clamp the auger's tubular drive body against a portion of the metal sleeve diametrically opposite the tapped bore in said sleeve, or to release said clamp.

Such metal construction has, heretofore, been considered essential, to provide the necessary grip strength to effect an operative driving connection between the drive means and the tubular drive body of the auger wire.

It would be desirable to materially reduce the cost of an auger of the type referred to above, and to provide simplified means for effecting a clamp of the auger's tubular drive body.

Therefore, it is an object of this invention to provide an improved auger construction wherein major portions thereof are formed of molded plastic and wherein said metal sleeve and tapping thereof, as used in prior art constructions, are eliminated, to reduce cost of construction while achieving an effective auger unit.

It is a further object of this invention to provide an auger wherein housing and handle portions thereof are formed of plastic, and to also provide integral bearing abutment portions thereon, through means of which an easily operable, but less expensive, auger construction may be achieved.

Further objects and advantages of this invention will become understood by one skilled in the art from the following description of the invention.

SUMMARY OF THE INVENTION

An auger is provided wherein major portions thereof are of molded plastic parts, which provide effective bearing structure between the plastic handle and the rotatable canister which drives the metal auger wire drive body. The canister itself is formed by two molded plastic shells joined together by screws. The lower canister shell provides a tubular section that extends downwardly through the handle. An effective coupling to the metal auger is provided using a plastic nut holder mounted on a portion of the tubular section of the lower canister, and only two inexpensive metal parts, a thumb screw and a standard tapped nut are required to complete the assembly.

DESCRIPTION OF THE PREFERRED EMBODIMENT

Figures 1, 2, 3:
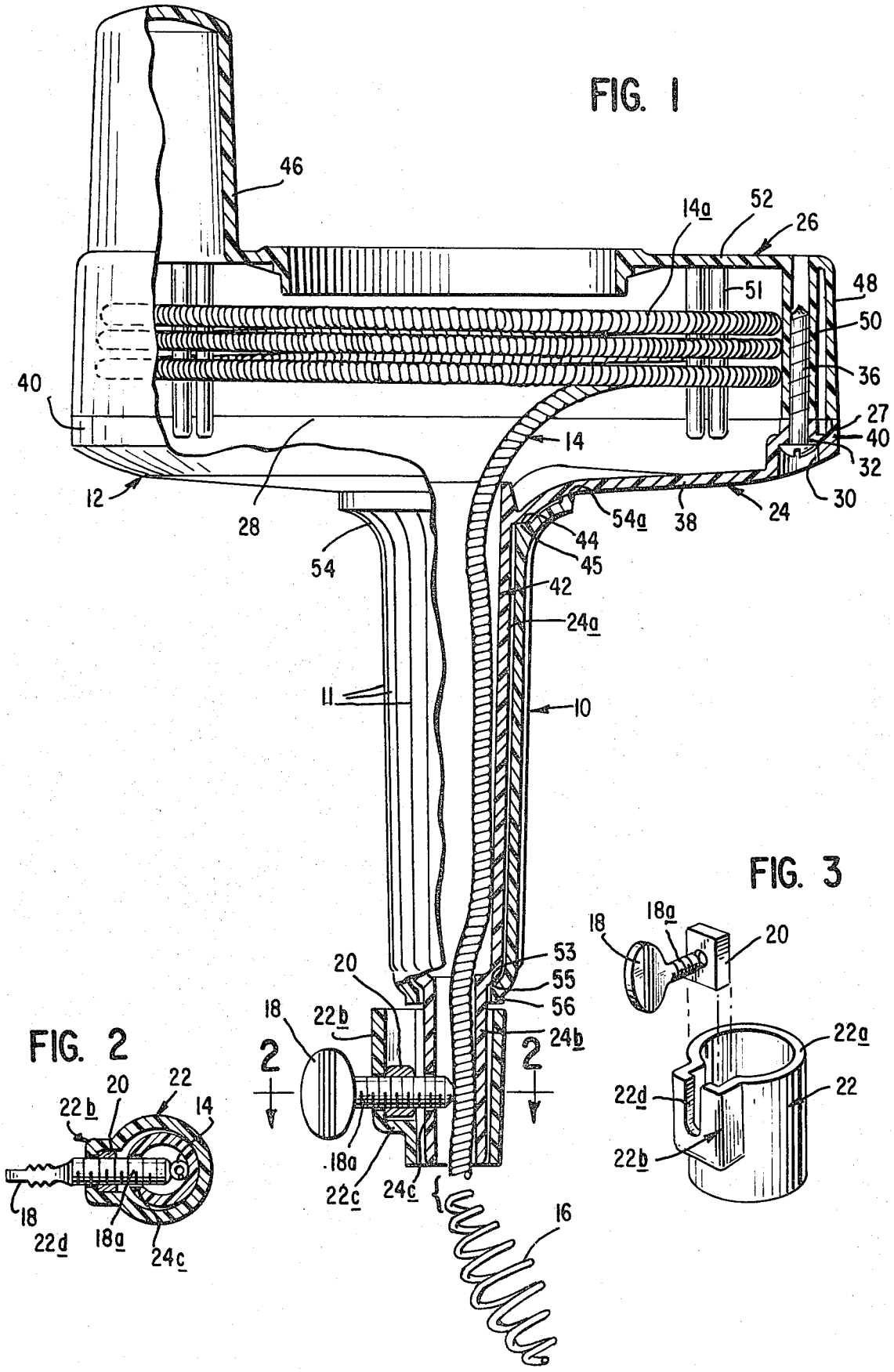
FIG. 1 is a vertical elevational view, partly in cross-section, illustrating an auger tool that embodies the features of this invention.
FIG. 2 is a cross-sectional view taken substantially along line 2—2 of FIG. 1.
FIG. 3 is a perspective view showing the nut holder, and illustrating by broken lines how the nut and thumb screw are secured together for purposes of sub-assembly onto the plastic nut holder before the nut holder is assembled on the canister auger as seen in FIG. 1.

Referring now to the FIGURES of the drawing, the improved auger includes tubular support handle 10 of an axial length to be conveniently held in one hand, a storage canister generally indicated at 12, that is drivingly rotatable relative to the handle 10, an elongated, helically wound auger wire 14 with an enlarged helical head 16 at the exposed working end thereof, a metal thumb screw 18, a standard metal nut 20, and a plastic nut holder 22. As is known in the art, the canister 12 is to provide the drive means for driving, or rotating, the auger that extends therefrom.

The canister 12 is a body that is principally molded of plastic, preferably a high strength material, such as polypropylene. Canister 12 includes a lower shell 24 and an upper shell 26 whose circumferential flanges mate along mating line 27 to provide a hollow, drum-like chamber 28 in which is stored the excess length **14*a* of auger wire 14**.

Lower shell 24 is provided with four countersunk recesses 30 each with an axially aligned bore 32, spaced equally along the circumference of shell 24 and adapted to receive an assembly screw 36. Lower shell 24 has a transverse annular bottom wall 38 that extends from outer circumferential flange 40 to a downwardly projecting central tubular sleeve 42. Formed on wall 38 adjacent sleeve 42 is an annular bearing shoulder 44 against which shoulder 45 on support handle 10 abuts.

Upper shell 26 is an annular part from which extends an integrally molded, hollow crank handle 46 for rotatably driving the canister 12. Shell 26 includes an outer circumferential flange 48 which is of a diametral size to mate against circumferential flange 40 on lower shell 24. Four circumferentially spaced sleeves 50 are integral with flange 40 and located to grippingly receive the threaded stems of screws 36 which operate to assemble and clamp shells 24 and 26 together. An annular transverse wall 52 extends radially inwardly from circumferential flange 48 and serves at the top wall of the canister. Axially elongated rigidifying and centering ribs 51 are formed integral with and extend along the inner surface of flange 48 from transverse wall 52 past mating line 27 to slidingly engage inner surface of flange 40 on lower shell 24.

The central tubular sleeve 42 of lower shell 24 is elongated to provide a journal portion **24*a* that is of a length substantially coextensive with handle 10, and a diametrically reduced tubular stud 24*b* that projects through and below the lower end of handle 10. The outer surface of the end of journal portion 24*a* that is distal from bottom wall 38 is rounded and turned in at 50. The handle 10, adjacent its lower end, is similarly rounded and turned in at 55 to cooperate with rounding 53 on tubular sleeve 42**.

The cooperation of surfaces 44 and 53 on sleeve 42, respectively with adjacent surfaces 45 and 55 on handle 10, provides an effective bearing, or journal, arrangement which reduces friction between the parts and permits of easy rotation of canister 12 relative to handle 10. The handle 10 is also molded of plastic, preferably a high strength material. The exterior of handle 10 is fluted at 11 to provide a good purchase or grip.

The upper end of handle 10 includes a cantilevered, belled, portion 54 which provides a resilient, cantilever beam-like support between handle 10 and lower shell 24 of canister 12, as best seen in FIG. 1, with portion 54 terminating in a circumferential flange 54*a* which engages wall 38 of the lower canister shell 24 radially outwardly of the bearing engagement between surfaces 44 and 45.

The lower end of handle 10 below rounded portion 55 provides a relatively short tubular stud 56 which surrounds only a short axial portion of tubular stud 24*b*.

The diametrically reduced tubular stud 24*b* is of an internal diameter somewhat, but not too much, greater than the diameter of the elongated auger wire 14, with the exception that the maximum diameter of enlarged head 16 is greater than the internal diameter of stud 24*b*, as seen in FIG. 1. The wall of stud 24*b* is pierced, or apertured, to provide a lateral aperture, or opening, 24*c* through which the stem 18*a* of thumb screw 18 freely passes. The sizes of the internal diameter of stud 24*b*, the diameter of auger wire 14, and stem 18*a* are so selected that when thumb screw 18 has been moved to the clamp position seen in FIG. 2, the free end of stem 18*a* will always engage and clamp wire 14 against a portion of the inner wall of stud 24*b* opposite opening 24*c*.

In order to provide that thumb screw 18 will effect its clamping action, there is provided a nut holder 22, molded of plastic, and a standard square sided metal nut 20. The nut holder 22 is a sleeve-like part that has an internal diameter greater than the external diameter of stud 24*b*, but when in position as seen in FIGS. 1 and 2, the cylindrical portion 22*a* of the upper edge of the tubular portion of nut holder 22 will be in position to abut stud 56, as best illustrated in FIG. 1. Nut holder 22 has a bulged out upper portion 22*b* of a size and shape to slidably receive therein, by movement in a direction axially of nut holder 22, the square sided metal nut 20. Said bulged out portion 22*b* is tangential to the generally circular shape of the remainder of the nut holder, and said bulged portion provides a lower transverse support wall 22*c* against which one edge of nut 20 may abut, and an axially elongated slot 22*d*, that opens laterally or radially of the axis of holder 22, and through which the shank of the stem 18*a* of thumb screw 18 will move, in assembling thumb screw 18 with nut 20 threaded thereon into nut holder 22, as illustrated in FIG. 3.

When the nut holder 22 and thumb screw 18 are fully assembled as seen in FIG. 1, the free end of stem 18*a* is positioned to laterally, or radially, enter opening 24*c* in stud 24*b*. As axial pressure is applied by the terminus of the shank of clamp, or thumb screw, 18 against auger body 14, by tightening up thumb screw 18, the force on nut 20 reacts against nut holder 22 and operates to pull the portion of nut holder 22 that is diametrically opposite nut 20 against stud 24*b*, as seen in FIG. 2, and the friction between holder 22 and stud 24*b* prevents dislocation of holder 22 downwardly relative to stud 24*b*. Similarly, once nut holder 22 with thumb screw 18 sub-assembled thereon has been assembled, or telescoped, onto stud 24*b*, the nut 20 cannot escape upwardly through the open top of bulged out portion 22*b*, as that bulged out portion is overlain by the lower end of handle 10, as seen in FIG. 1.

While there has been disclosed one particular form of our invention, it is intended that the scope of our invention be measured solely by the breadth of the claims herein.

We claim:

1. In an auger device that includes an elongated, helically wound, auger wire with an enlarged head at the exposed working end of said auger wire, driver means for selectively rotating said exposed working end of said auger wire, said driver means including a laterally enlarged storage housing, for storing the excess length of the auger wire, with an axially elongated tubular guide extending therefrom and from which the working end of the auger wire projects, and an elongated tubular journal sleeve surrounding a portion of said tubular guide and being of a length to be conveniently held in one hand while the driver means and said exposed working end of the auger wire are rotated by the other hand; the improvement comprising, in combination:

an end of the tubular guide projecting beyond said journal sleeve and having a first laterally opening aperture therein;

a nut holder constructed for encirclement of a portion of said tubular guide that projects beyond said journal sleeve;

a second lateral aperture in said nut holder adapted to be axially aligned with said first laterally opening aperture; said nut holder being shaped and arranged to provide therein a pocket means adapted to receive and properly position therein a nut-shaped element;

a threaded nut held in said pocket means with its bore aligned with and spaced between said first and second lateral apertures; and an elongated, threaded clamp pin shank with a manually actuatable head at the outer end thereof, said pin being threaded through said nut, and with its inner end extending freely through said first lateral aperture to provide for selective clamping of the auger wire between the terminus of the inner end of the clamp pin and the tubular guide.

2. A construction as in claim 1 wherein said second lateral aperture in said nut holder is an axially elongated slot.

3. A construction as in claim 1 wherein the pocket means is shaped to provide a transverse shoulder for supporting the threaded nut at a position where the inner end of the clamp pin will be aligned with said first laterally opening aperture.

4. A construction as in claim 1 wherein axially spaced portions of the tubular journal sleeve, and axially spaced portions of the housing means and tubular guide, are shaped and arranged to provide axially facing bearing abutments which limit telescoping of the journal sleeve along the tubular guide.

5. A construction as in claim 1 wherein said elements of the combination, with the exception of the auger wire, nut, and clamp pin, are formed of a molded plastic.

6. A construction as in claim 1 wherein the tubular journal sleeve is provided with elongated flutes along the exterior surface to accommodate manual gripping of the journal sleeve.

7. A construction as in claim 5 wherein said cylindrical housing means is defined and provided by mating, hollow, upper and lower molded shells that are secured together by a plurality of axially extending screw threaded members.

8. A construction as in claim 7 wherein the lower shell and elongated tubular guide are integrally molded, and wherein the upper shell has a drive handle provided thereon located eccentrically of the longitudinal axis of the tubular guide.

9. A construction as in claim 7 wherein the upper shell has a plurality of circumferentially spaced, axially extending, rigidifying, ribs thereon, of a length to telescope into the lower shell and to slidingly engage an inner surface of the lower shell.

* * * * *